US011925848B2

(12) United States Patent
Brush et al.

(10) Patent No.: US 11,925,848 B2
(45) Date of Patent: Mar. 12, 2024

(54) COMBAT APPLICATIONS PARTNER

(71) Applicant: Shuhari Group, LLC, West Indies (KN)

(72) Inventors: Kodiak Brush, Carlsbad, CA (US); Chad Skelton, Carlsbad, CA (US); Travis Downing, Carlsbad, CA (US)

(73) Assignee: Shuhari Group, LLC, West Indies (KN)

( * ) Notice: Subject to any disclaimer, the term of this patent is extended or adjusted under 35 U.S.C. 154(b) by 121 days.

(21) Appl. No.: 17/517,972

(22) Filed: Nov. 3, 2021

(65) Prior Publication Data

US 2022/0134205 A1 May 5, 2022

Related U.S. Application Data

(60) Provisional application No. 63/109,068, filed on Nov. 3, 2020.

(51) Int. Cl.

| | |
|---|---|
| ***A63B 69/34*** | (2006.01) |
| ***A63B 69/20*** | (2006.01) |
| ***A63B 69/24*** | (2006.01) |
| ***A63B 69/32*** | (2006.01) |

(52) U.S. Cl.

CPC ..... *A63B 69/34* (2013.01); *A63B 69/215* (2022.08); *A63B 69/24* (2013.01); *A63B 69/32* (2013.01); *A63B 2220/51* (2013.01); *A63B 2225/50* (2013.01); *A63B 2225/74* (2020.08); *A63B 2244/10* (2013.01)

(58) Field of Classification Search

CPC ..... A63B 69/34; A63B 2024/004; A63B 71/0622; A63B 69/215; A63B 69/20; A63B 69/24; A63B 69/32; A63B 2220/51; A63B 2225/50; A63B 2225/74; A63B 2244/10; A63B 2214/00

See application file for complete search history.

(56) References Cited

U.S. PATENT DOCUMENTS

| | | | | |
|---|---|---|---|---|
| 7,463,001 | B2 | 12/2008 | Tsurukawa | |
| 8,996,174 | B2 | 3/2015 | Brooks et al. | |
| 9,968,838 | B2 * | 5/2018 | Daniels | A63B 69/215 |
| 2008/0026917 | A1 | 1/2008 | Campana | |
| 2014/0378281 | A1 | 12/2014 | Mazi | |

(Continued)

FOREIGN PATENT DOCUMENTS

| | | |
|---|---|---|
| CN | 211486475 | 9/2020 |
| KR | 2001-0113579 | 12/2001 |

OTHER PUBLICATIONS

International Search Report and Written Opinion for Application No. PCT/US2021/057892, dated Feb. 25, 2022.

*Primary Examiner* — Megan Anderson

(74) *Attorney, Agent, or Firm* — C. Tumey Law Group PLLC

(57) ABSTRACT

A variety of systems and methods are disclosed, including, an embodiment comprising a training system comprising a training dummy, a base, and a mobile phone application, and another embodiment comprising a method for training with a training system comprising applying a physical force to a training dummy, detecting the physical force via a plurality of sensors disposed in the training dummy, and adjusting at least one parameter of physical force based in part on feedback from the detected physical force via a mobile phone application.

20 Claims, 9 Drawing Sheets

(56) References Cited

U.S. PATENT DOCUMENTS

| | | | | |
|---|---|---|---|---|
| 2015/0273307 | A1* | 10/2015 | Karimi | A63B 69/22 482/8 |
| 2019/0255411 | A1 | 8/2019 | He | |
| 2019/0339046 | A1* | 11/2019 | Herrmann | F41J 5/14 |
| 2019/0358821 | A1 | 11/2019 | Yamada et al. | |
| 2020/0051456 | A1* | 2/2020 | Connell | A63B 69/002 |

* cited by examiner

COMBAT APPLICATIONS PARTNER

BACKGROUND

Martial arts training devices and systems may provide a simulated environment for practicing various techniques and skills in martial and combat arts. Punching bags and mannequins have been the primary training systems for training in combat arts such as boxing, mixed martial arts, and the like. The punching bag and mannequin have served as a substitute for a human opponent in practice.

The lack of functionality of these combat trainers is evident in lacking interactive, realistic, and responsive elements to a human opponent. There is a need for a training apparatus configured to simulate a human opponent that may prioritize robustness and durability to ensure quality in training. The construction of these combat training apparatuses may comprise technology for training feedback, gamification, and remote coaching functionalities. Humanoid robots, in particular, are robots having an approximately human structure or appearance with the structural complexity of the humanoid robot being largely dependent upon the nature of the task being performed.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1C:
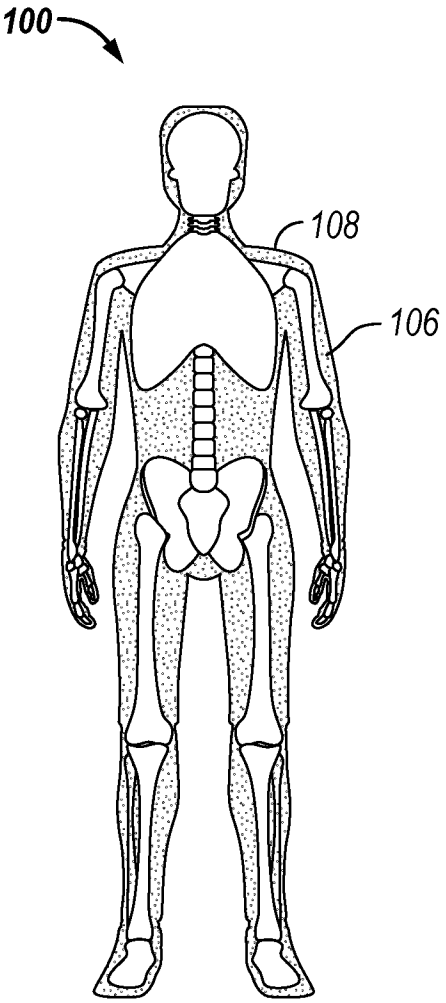
FIG. 1C illustrates cushioned layer of the training dummy.

Disclosed herein is an example training dummy that may be utilized in a training system. The training system may comprise a training dummy, a base, and an external control, which are discussed below in further detail. Further disclosed herein is an example method of training with a training system. The method may comprise applying a physical force to a training dummy and modifying at least one parameter of the training dummy based in part on the application of physical force.

This disclosure relates generally to a training system, and more particularly a humanoid training system configured and adapted to replace a human opponent. The training system may be programmed to effect various ranges of motion to allow application and contact of physical forces upon a training dummy such as strikes, punches, blocks, and the like to simulate combat sports including but not limited to Mixed Martial Arts (MMA), Boxing, Muay Thai, Kickboxing, Filipino Martial Arts, Judo, Wrestling, Self-Defense, Combatives and the like. In examples, the training system may provide a training environment without the need of a human opponent. The present training system may comprise the training dummy designed with a collection of commands configured for executable mobility, functionality, and task handling in various training environments. The training environment may be simulated by the training dummy to provide movement and contact points that are representative of a human opponent, for training.

The training system may also comprise a moveable base for supplying power and supporting the training dummy when recharging. The moveable base may be structurally designed to bear the weight of the training dummy when mounted to the base. Training dummy may be engaged to a human opponent, to train, demonstrate, or compete against the human opponent or any inanimate object such as traditional training equipment, or another dummy. The term user is defined as a human opponent training in a specified combat sport with the training dummy. The training dummy may be engaged while mounted on the base via an attachment rail to be discussed later in detail. In other examples, the training dummy may be engaged independently while disconnected from the base. The training system may observe its surroundings and force imparted on itself via various diverse sensors disposed throughout the training dummy and base. Measurements from such sensors may be transmitted via electrical connection or wirelessly to central processing units disposed within the training dummy or base. In other examples, measurements may be transmitted via electrical connection or wirelessly to multiple microprocessors distributed throughout the training dummy and the base. In either case, measurements may be processed for the purpose of updating dummy parameters. In non-limiting examples, dummy parameters may comprise selecting fighting levels based upon skill and difficulty, different fighting techniques as listed above, speed and output power of the dummy, autonomous or manual fighting instructions and the like. Additionally, dummy parameters provide instructions for sequencing coordinated movements of actuators (to be discussed below) to resemble single and combination movements resembling punching, kicking, dodging, and the like. In examples, commands may comprise one or more dummy parameters. Herein, commands are defined as instructions for how training dummy 100 operates. These commands may control how the dummy is engaged to its opponent. Other commands may comprise instructions to LED lights and speakers disposed on and/or in the training dummy. A user may be provided processed measurements through an external control. As such, the user may customize various dummy parameters of the training dummy for training, competing or demonstrating purposes based on the processed measurements and desired training, competing or demonstrating through the external control. Further, a feedback loop may be implemented to provide adjustments to dummy parameters based on processed measurements from the central processing units or multiple microprocessors, to be discussed in detail below.

The robot training system may comprise the external control, to be discussed in detail below. The external control may comprise an external software control, an external electronic control, and combinations thereof. The external control may comprise but not limited to a mobile device, mobile application, mobile phone, mobile phone application, any remote-control device. The training system may be connected wirelessly to one or more external controls.

Figure 1B:
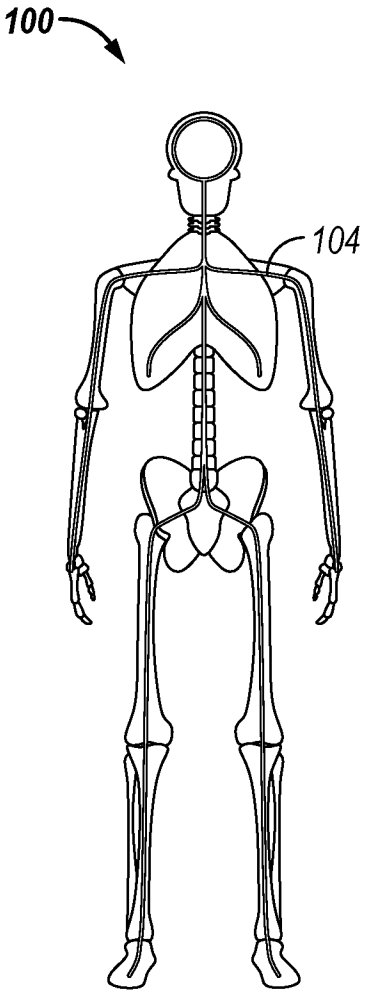
FIG. 1B illustrates an electrical circuit of the training dummy.
Figure 1A:
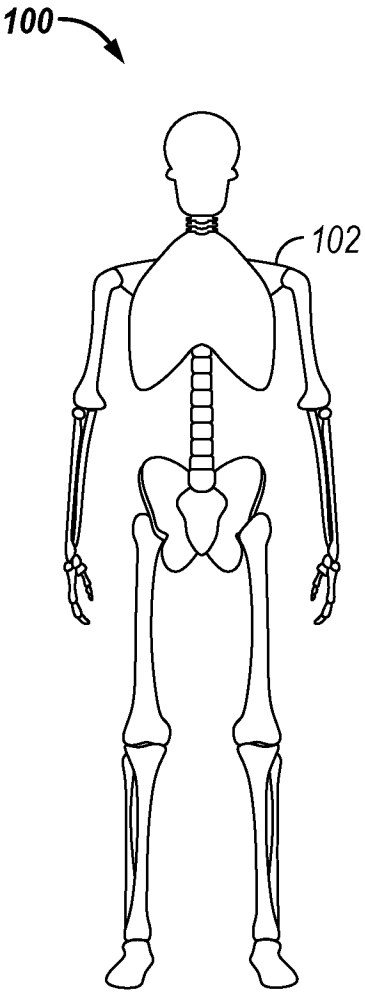
FIG. 1A illustrates structural layout of the training dummy.

FIG. 1A depicts structure 102 of training dummy 100. Structure 102 may form the main structure of training dummy 100. Additionally, structure 102 may be rigid and formed from any known metal such as aluminum or any known metallic alloy. Structure 102 may further comprise a shell (not illustrated). The shell may hold structure 102 in place and separate structure 102 from other components of training dummy 100, to be discussed below. The shell may be formed by plastic, carbon fiber, or any alternative light material able to seal structure 102.

FIG. 1B depicts electronic circuit 104. Electronic circuit 104 may be implemented throughout training dummy 100 and have the capability to supply power as well as provide a means for transmitted signals to be received. As such, direct electrical connections of different components throughout training dummy 100, to be discussed below may be implemented through electronic circuit 104.

FIG. 1C depicts a padded layer 106 and wrapping layer 108. Padded layer 106 may provide a cushion to maintain the safety of the user as well as the integrity of structure 102 and electronic circuit 104. Padded layer 106 may be formed from Ethylene-vinyl acetate or any other cushioned or padded material and allow for integration of electronic circuit 104 within padded layer 106. Wrapping layer 108 may encompass and/or enclose the entirety of training dummy 100 in order to hold and compress padded layer 106 and wrapping layer 108 may be formed by silicon skin, vinyl, or any skin like material capable of surrounding training dummy 100.

Figure 2:
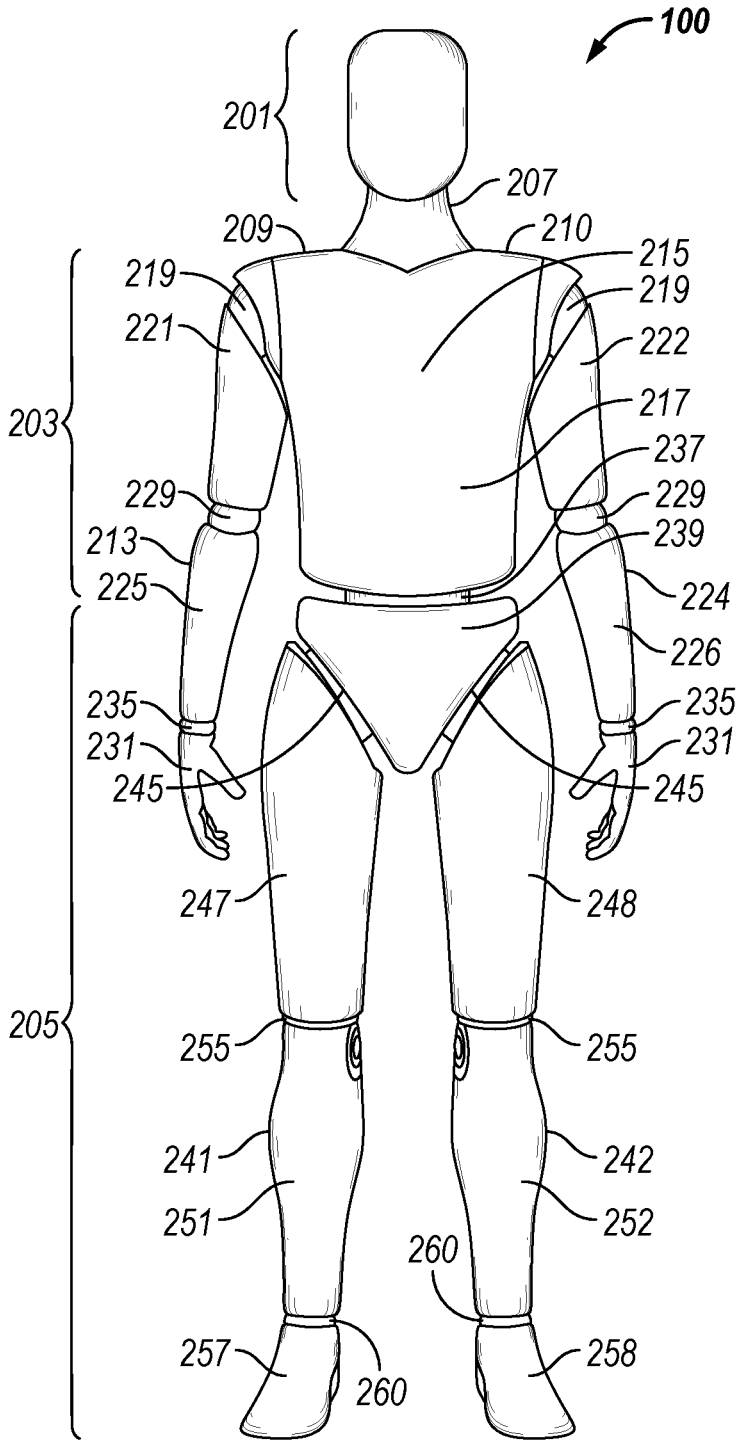
FIG. 2 illustrates the body of the training dummy.

FIG. 2. illustrates a main body of a training dummy 100. In various embodiments, the training dummy 100 may be characterized in a representative form of a human body. The main body may comprise a plurality of body components. The body components may comprise a first section 201, a second section 203, and a third section 205 interconnected at one or more articulation points. The articulation points may also connect components to each other within each section and be one or more joints that are configured to perform one or more tasks or movements with multiple degrees of freedom and ranges of motion. The joints may comprise but are not limited to a first shoulder 209 and a second shoulder 210, elbow joint 229, a wrist joint 235, a hip joint 245, a knee joint 255, and an ankle joint 260. Training dummy 100 may be an articulated training dummy and may be in a scale representative of an average human.

First section 201 may comprise a head like structure. The head like structure may be a metallic cage housing one or more electronic components. First section 201 may be seated on a neck 207. Neck 207 may be a connecting member of varying length and may be composed of any suitable material to support a weight of the head like structure. First section 201 any other suitable feature representative of a human head and face.

Second section 203 may be a midsection and may comprise a torso like structure. The torso like structure may be human-like in details and may comprise, but not limited to, a pair of shoulders 209, 210, i.e., a first shoulder 209 and a second shoulder 210 below the neck 207 and extending from opposite sides of the second section 203. A pair of arms 213, 214 i.e., a first arm 213, and a second arm 214 attached laterally to each shoulder 209, 210, a chest 215 below the pair of shoulders 209, 210, and an abdomen 217 below the chest 215. Each first and second shoulder 209, 210 is connected to the first and second arm 213, 214, respectively by the shoulder joint 219. Each first and second arm 213, 214 may comprise a bicep 221, 222, i.e., a first bicep 221 and a second bicep 222 connected to a forearm 225, 226, i.e., a first forearm 225, and a second forearm 226 by the elbow joint 229. Each first and second forearm 225, 226 may be connected to a hand 231, 232 i.e., a first hand 231, and a second hand 232 by the wrist joint 235.

Third section 205 may be a lower section and may comprise a trunk like structure. The trunk like structure may comprise a pelvic base 239 of any suitable shape, and a pair of legs 241, 242, i.e., a first leg 241, and a second leg 242 attached to opposite sides of pelvic base 239 by hip joint 245 attached to a top face of pelvic base 239. Each first and second leg 241, 242 may comprise a thigh 247, 248, i.e. a first thigh 247, and a second thigh 248, a shin 251, 252, i.e. a first shin 251, and a second shin 252 connected to the first and second thigh 247, 248 respectively by the knee joint 255, and a foot 257, 258, i.e. a first foot 257, and a second foot 258, connected to the first and second shin 251, 252 respectively by the ankle joint 260. Variable resistance may be placed in the ball and socket joint in the first and second shoulders 209 and 210, each elbow joint 229, articulated waist 237, and each knee joint 255 to dynamically respond and resist exterior forces.

First section 201 may be rotatably connected to second section 203 by neck 207. Second section 203 may extend to third section 205 and be connected by articulated waist 237. The articulated waist may be a connecting member similar in shape and function as the neck 207. The articulated waist may be composed of any suitable material to support a weight of the torso like structures and the head like structures. As representative of a human body, the training dummy may be symmetrical in structure and design. The training dummy may comprise a plurality of body components representative of various body parts of the human body. Training dummy 100 and the plurality of body components may be made of and/or covered with a material suitable to the shape and design of the body component, and suitable to the configured task or movement to be performed. The body components of the training dummy may also be articulated in other suitable configurations.

Figure 3:
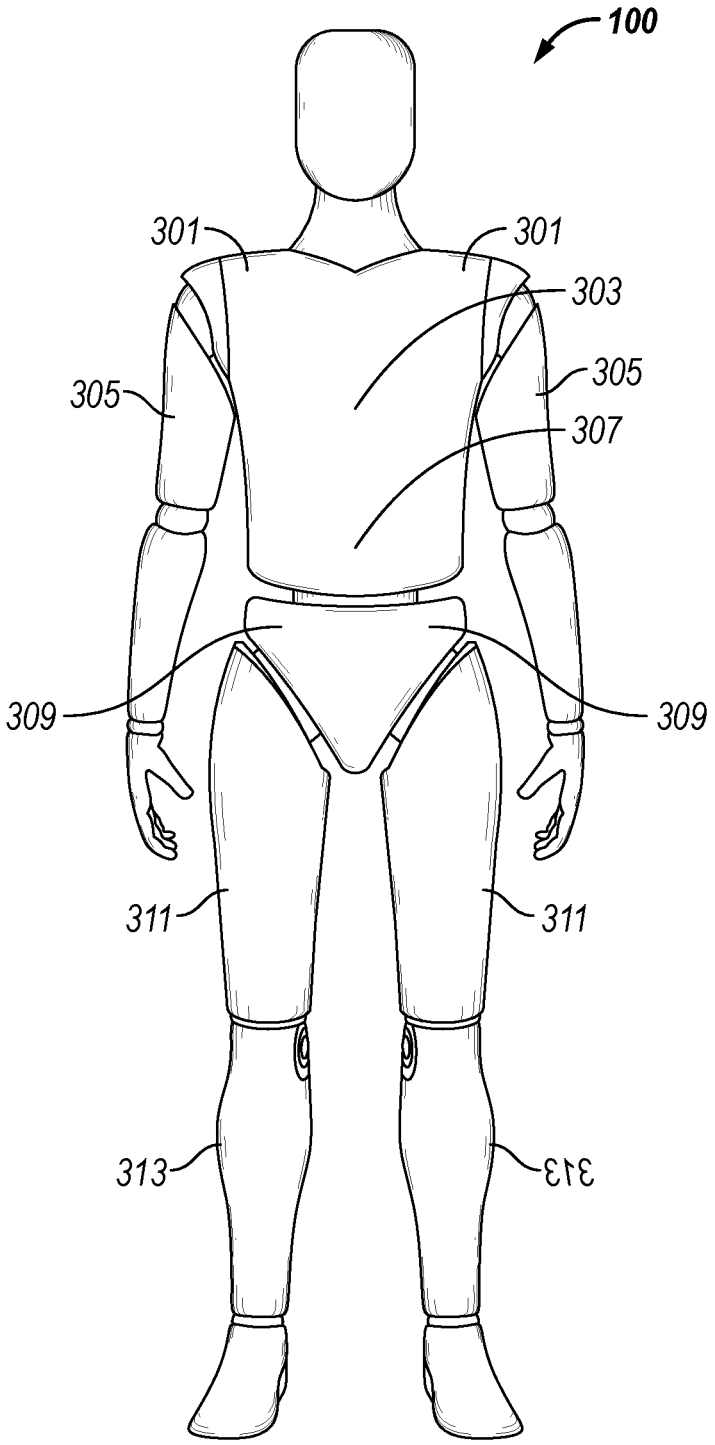
FIG. 3 illustrates a plurality of actuators of the training dummy.

Articulation of the body components of training dummy 100, as displayed in FIG. 2, may contain and be driven by a plurality of actuators. The actuators may comprise but not limited to servo motors, joint motors, linear actuators, rotary actuators, and combinations thereof. The actuators may be configured to allow various ranges of motion and movement. In particular, the plurality of actuators may be disposed in or around the plurality of joints. FIG. 3 illustrates a plurality of actuators disposed throughout training dummy 100. The actuators may be disposed in the torso of training dummy 100, which may comprise each shoulder 301, chest 303, abdomen 307, and each bicep 305. The plurality of actuators may be disposed in the trunk of training dummy 100. The trunk may comprise, but not limited to pelvic base 309, each thigh 311, and each calf 313. Additionally, actuators may be disposed at any other suitable location within the training dummy.

Figure 4:
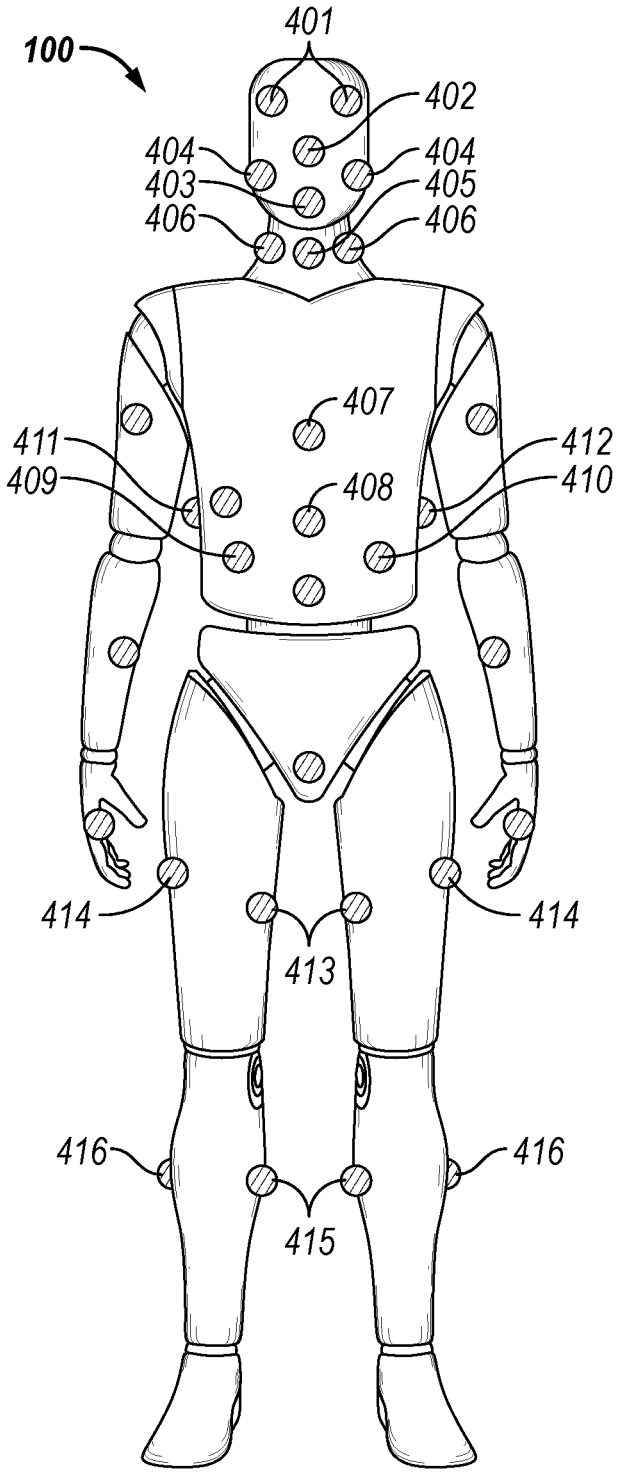
FIG. 4 illustrates a plurality of strike zones of the training dummy.

FIG. 4 illustrates a plurality of strike zones disposed throughout training dummy 100. Each strike zone may comprise force sensors disposed within padding layer 106 (e.g., referring to FIG. 1C). The force sensors may be any implementation of force-sensitive resistors (FSRs) and connected to electronic circuit 104 (e.g., referring to FIG. 1). Therefore, measurements from FSRs may be transmitted throughout training dummy 100, specifically to a central processing unit 605 to be discussed later. An FSR may observe a force in its specified strike zone. Such forces may occur from physical forces representative of that of martial and combat sports, i.e., punch, hit, strike, slap, pound, push and combinations thereof. Strike zones of training dummy 100 may comprise FSRs. Strike zones of first section 201 (e.g., referring to FIG. 2) may be located at temples 401, nose 402, chin 403, jaw 404, inner throat 405, and outer throat 406. The torso of training dummy 100 may comprise strike zones in representative locations of second section 203 located at sternum 407, xiphoid process, center abdomen 408, first abdomen 409, second abdomen 410, liver, first kidney 411 and second kidney 412). Third structure 205 of the training dummy may comprise located in third section 205 may comprise located at inner thighs 413, outer thighs 414, inner claves 415, and outer calves 416. Additionally, FSRs may be disposed at any other suitable location within training dummy 100. Each force applied to training dummy 100 may be compared to a programable threshold, once received at central processing unit 605.

Figure 5:
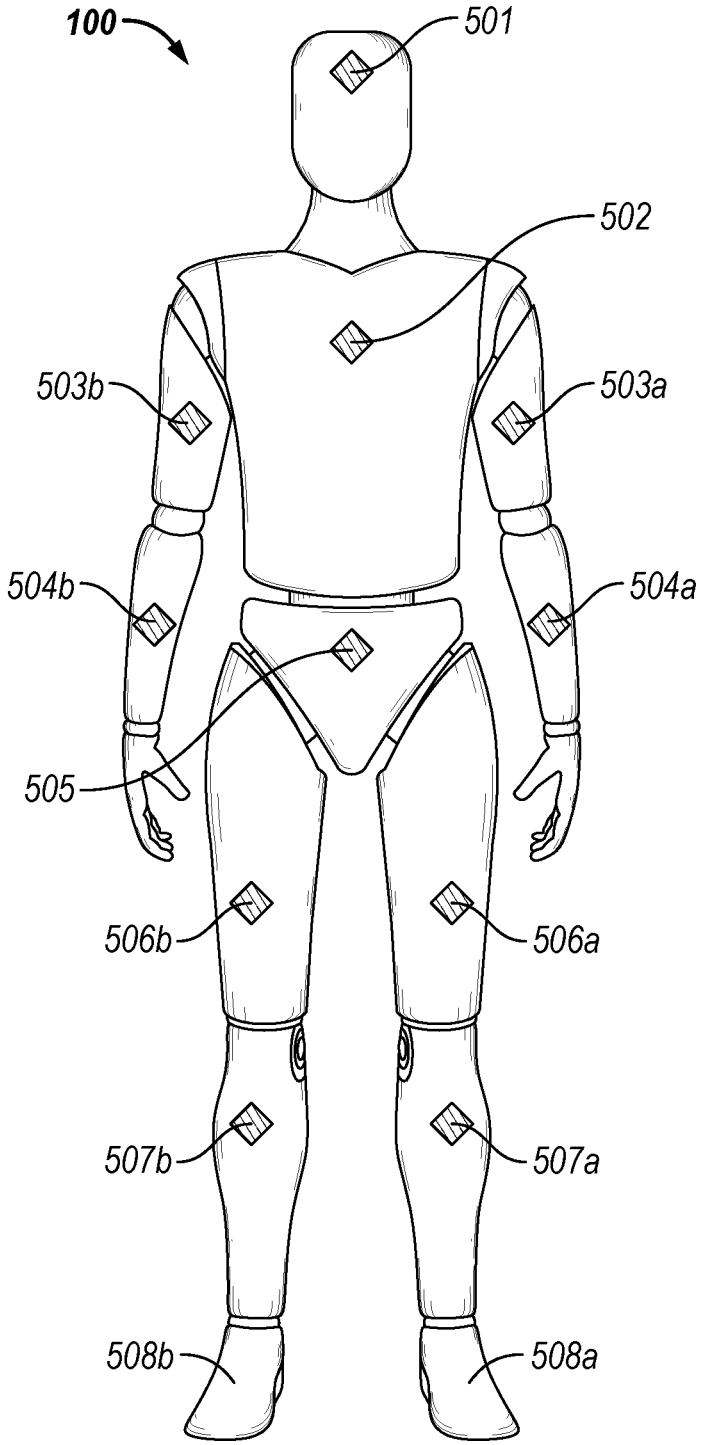
FIG. 5 illustrates a plurality of movement zones of the training.

FIG. 5 illustrates a plurality of movement zones disposed throughout training dummy 100. Movement zones may be configured to measure strike forces in conjunction with the aforementioned FSRs and track a spatial orientation of each body component as well as the speed, acceleration, and movements. Each movement zone may comprise one or more accelerometers and gyroscopes connected to electronic circuit 104 (e.g., referring to FIG. 1). Therefore, measurements from accelerometers and gyroscopes may be transmitted throughout training dummy 100, specifically to a central processing unit 605, to be discussed later. Movement zones may be disposed throughout various components of the body including but not limited to chest movement zone 502, bicep movement zones 503*a* and 503*b*, forearm movement zones 504*a* and 504*b*, pelvic base movement zone 505, thigh movement zones 506*a* and 506*b*, shin movement zones 507*a* and 507*b*, and foot movement zones 508*a* and 508*b*, and combinations thereof. Additionally, movement zones may be disposed at any other suitable location within the training dummy 100. Training dummy 100 may further comprise visual sensors 501 connected to electronic circuit 104 (e.g., referring to FIG. 1). Therefore, measurements from visual sensors may be transmitted throughout training dummy 100, specifically to a central processing unit 605, to be discussed later. Visual sensors 501 may observe physical properties which allowing for a visual representation of training dummy 100 surrounding's. Implementation of visual sensors 501 may be sonar transmitting and receiving, acoustic transmitters and receivers or transducers, traditional camera deployment, radar with electromagnetic waves, or any combination thereof.

Figure 6:
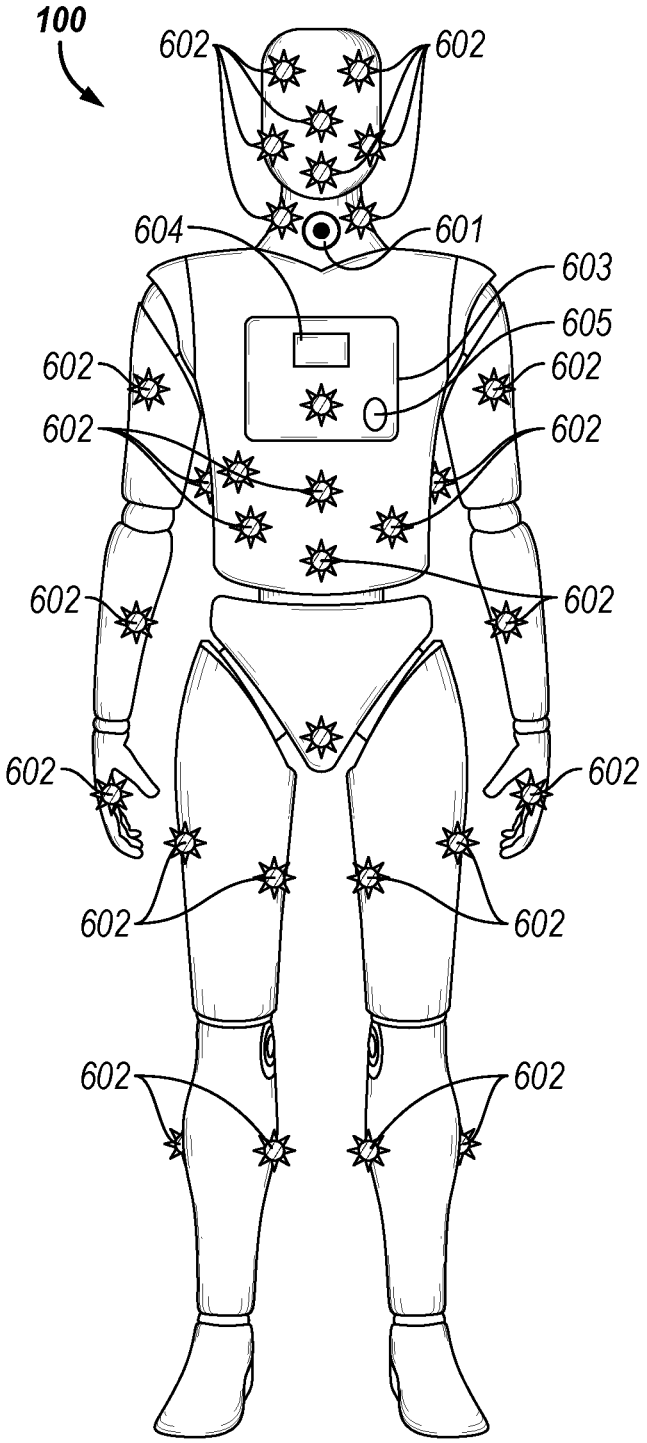
FIG. 6 illustrates of a dummy user interface, dummy charging electronics, and dummy processors of the training dummy.

FIG. 6 illustrates a variety of other features of training dummy 100. For example, power button 601 may be configured to turn on or shut down training dummy 100. A plurality of instruction points 602 may comprise light emitting diodes ("LED's") and/or typical speaker deployment may be connected to electronic circuit 104 (e.g., referring to FIG. 1). Instruction points may provide feedback to a user while training dummy 100 is engaged. Therefore, commands from central processing unit 605 may be transmitted throughout training dummy 100 to instruction points 602. Instruction points 602 may be disposed at any location on training dummy 100.

In particular, instruction points 602 located at strike zones 401-416 may provide visual feedback and instructions to a user based on measurements received from strike zones 401-416. For example, a programmable threshold of force may be generated from the dummy parameters and directly compared to measurements from strike zones to produce a user's performance. Upon FSRs measurements compared to a programmable threshold of force, central processing unit 605 may transmit commands via electronic circuit 104 instructing LED's to emit a plurality of colors based on the user's performance. External control 800 may also transmit commands for LED's and speakers at instruction points 602. Additionally, training dummy 100 may comprise a battery management system ("BMS") 603. Through electrical circuit 104, BMS 603 may be governed by central processing unit 605 and provide power to components within training dummy 100 including but not limited to actuators 301-313, strike zones 401-416, movement zones 502-508, visual sensor 501, and instruction points 602. BMS 603 may comprise a battery level indicator 604 configured to provide a charge display of a power source, i.e., battery, disposed in the training body, and connections, i.e., ports and contacts, to allow recharging of the training dummy when connected and mounted to a base. A plurality of dummy microprocessors may be disposed throughout the training dummy and may be configured to drive the servo motors, LED's, read the sensors, and provide communication between a mobile application and the base.

Training dummy 100 may comprise a central processing unit 605. Central processing unit 605 may be implemented with electronic circuit 104 (e.g., referring to FIG. 1), allowing central processing unit 605 to transmit and/or receive measurements and/or commands to actuators 301-313 (e.g., referring to FIG. 3), strike zones 401-416 (e.g., referring to FIG. 4) movement zones 502-508 (e.g., referring to FIG. 5), visual sensor 501, and instruction points 602. As such, central processing unit 605 may store measurements from FSRs within strike zones 401-413, accelerometers and gyroscopes within movement zones 502-516, and visual sensors 501. Once acquired from actuators 301-313, strike zones 401-416, movement zones 502-508, or visual sensor 501 measurements may be transmitted to and stored on memory of processing unit 605 and subsequently processed. Processing may be performed in real-time during data acquisition while training dummy 100 is engaged or in an evaluation period after training dummy 100 was engaged. Processing may alternatively be performed while the training dummy 100 is mounted to the base or when training dummy 100 is disconnected.

Central processing unit 605 may be connected to an external control 800 and a base processing unit 705 via communication links 906 and 908, to be discussed later. Communication links 906 and 908 may be executed wirelessly or through a direct electrical connection. Communication link 906 may provide processed measurements to serve as an output from central processing unit 605 to extern control 800. Likewise, communication link 906 also may provide commands from external control 800 to serve as an input to central processing unit 605. Additionally, central processing unit 605 may comprise an algorithm designed to receive measurements from actuators 301-313, strike zones 401-416, movement zones 502-508, sensor 501 and output calculated commands back to central processing unit 605, to be discussed in detail below. Commands for updating dummy parameters may allow for dynamic control of how training dummy 100 is engaged in real time. Similarly, commands for updating instruction points 602 may allow LEDs to illuminate with different colors and perform audio outputs with speaker deployment. As previously described, central processing unit 605 may control actuators 301-313 and modify their outputs via commands of dummy parameters, yielding mobility and action to training dummy 100. Further, central processing unit 605 may utilize commands for base 700, to be discussed later. In examples, microprocessors may be implemented to work with or replace central processing unit 605.

Figure 7:
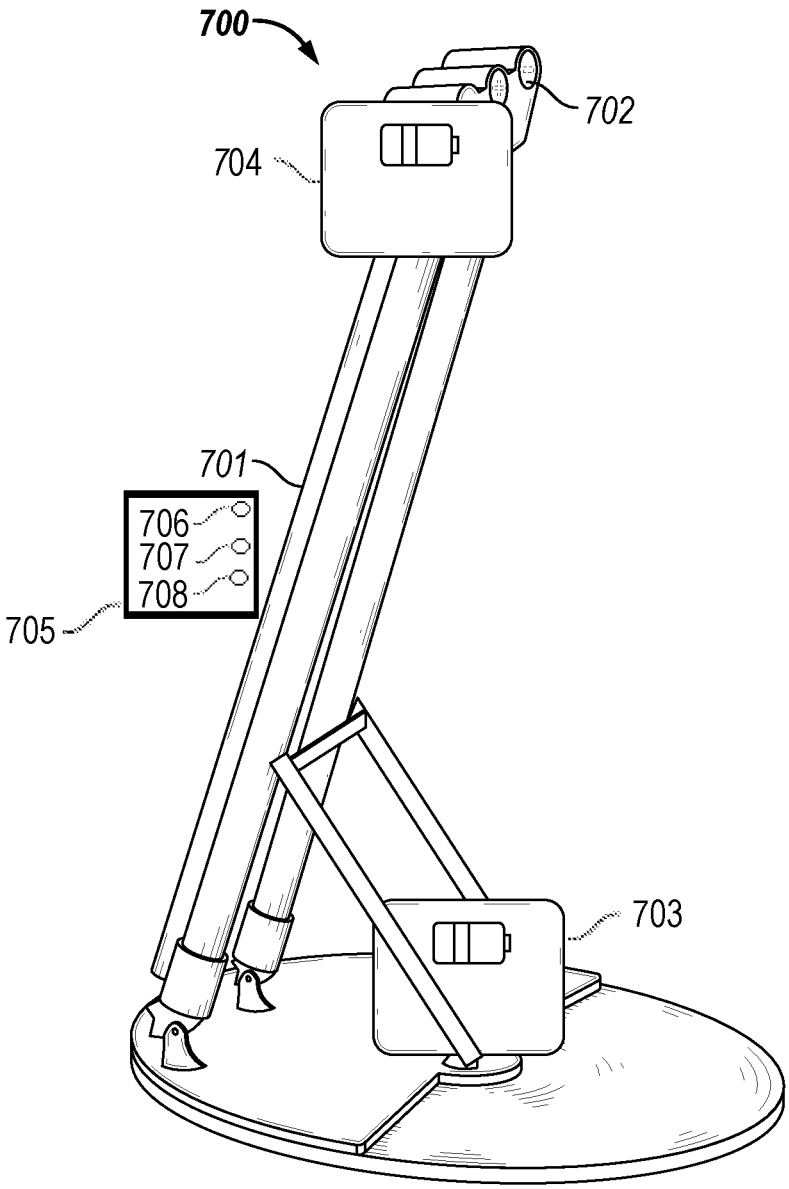
FIG. 7 illustrates a base for the training dummy.

Training dummy 100 may interface with a base 700, as illustrated in FIG. 7. Training dummy 100 may be engaged while connected to base 700. When training dummy 100 is mounted to base 700 it may provide support, movement, and electrical charging. Training dummy 100 may comprise an access port on its back, near the middle of the spine (not illustrated) where an attachment rail 701 on the base slots in and locks into place at connection ports 702. A quick-release button (not illustrated) may unlock attachment rail 701 and allow training dummy 100 to be removed from base 700. Connection ports 702 may provide electrical power and support for training dummy 100. Base 700 may comprise but is not limited to one or more base actuators (not illustrated), base charging electronics, base user interface 704, servo motors, and base processing unit 705.

Herein, base commands are defined as specific instructions used by base processing unit 705 to control and manipulate the base actuators to provide movement of base 700 and audio output 707. The base actuators may comprise, but are not limited to, linear actuators, rotation motors, and combinations thereof. Such an array of actuators and servo motors may allow for four degrees of freedom including vertical lifting, horizontal extension, and adjustments to yaw and pitch to the training dummy. The rotation motors may allow for a continuous 360° rotation of yaw orientation. Base user interface 704 may comprise but is not limited to a control panel allowing control of the base actuators, servo motors, and actuators 301-313 (e.g., referring to FIG. 3) and view of the status of base charging electronics. The base charging electronics may comprise but are not limited to a power supply 703. Power supply 703 may comprise, but is not limited to electric batteries, electric generators, AC-DC/DC-AC/AC-AC/DC-DC converters, power management systems, and the like.

In examples, base 700 may comprise a base processing unit 705. Base processing unit 705 may be connected to central processing unit 605 (e.g., referring to FIG. 6) and an external control 800 via communication links 908 and 910, to be discussed below. Communication links 908 and 910 may be executed wirelessly or through a direct electrical connection and provide base commands to serve as an input to base processing unit 705 from central processing unit 605 and external control. With received base commands, base processing unit 705 may control actuators, servo motors, and audio output 707. Additionally, base 700 may comprise audio input 706 and visual input 708. Measurements from audio input 706 may be oral commands received while training dummy 100 is engaged. Oral commands may be from a user or a user's coach to update dummy parameters or disengage training dummy 100. Such measurements may be recorded via any implementation for recording audio. Similarly, visual input 708 may measure a user's movements by implementation of a camera or any standard visual recording technique. Measurements from audio input 706 and visual input 708 may be processed by base processing unit 705. Processed measurements may be transmitted via communication links 908 and 910 from base processing unit 705 to central processing unit 605 and external control 800. As illustrated, audio input 706, audio output 707, and visual input 708 are located on base processing unit 705, however in other examples they may be placed on or around base 700. In examples, microprocessors may be implemented to work with or replace base processing unit 705.

Figure 8:
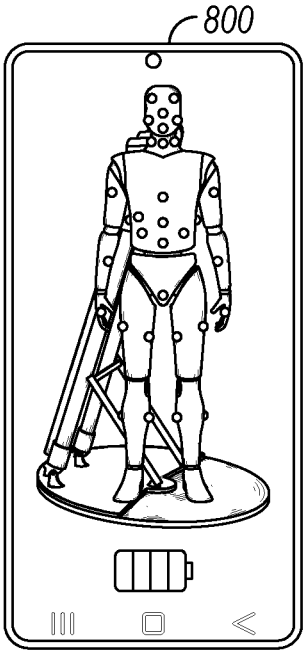
FIG. 8 illustrates an external control.

FIG. 8 illustrates an external control 800 with the functionality to communicate with training dummy 100 and base 700 via a communication links 906 and 910, to be discussed later. Communication links 906 and 910 may be executed wirelessly or through a direct electrical connection. External control 800 may also be configured as a means of communication with other wireless devices, i.e., computers, tablets, audio/video peripherals, and the like. As previously described, processed measurements may be transmitted to external control 800 via communication links 906 and 910. As such, processed measurements may be displayed to a user and/or a user's instructor to a user through the mobile phone application, or alternatively on external control 800. From processed measurements, commands and base commands may be generated on the mobile phone application or alternatively, on external control 800. External control 800 may comprise a user interface capable of displaying processed measurements and record manual and make autonomous commands and base commands. Commands and base commands may be generated in real time while training dummy 100 is engaged. External control 800 may comprise an application or a user interface to display the status of training dummy and how a user is performing under the current dummy parameters.

Figure 9:
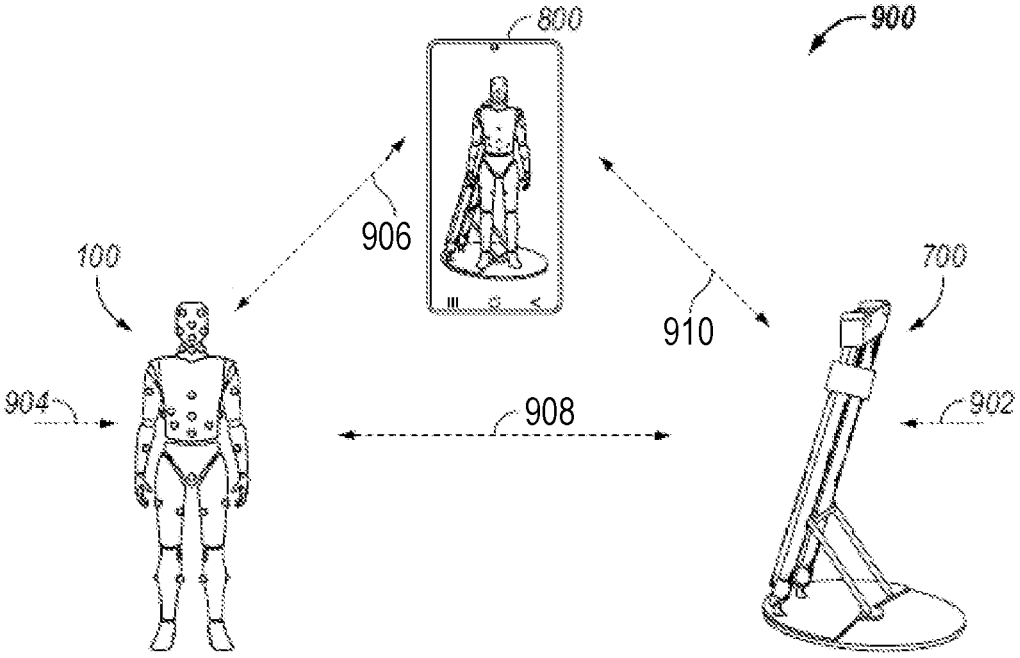
FIG. 9 illustrates a controls diagram for the training dummy, the base, and an external electronic control.

FIG. 9 illustrates a controls diagram of the training system. External control 800 may be connected to training dummy 100 via communication link 906. As previously described, communication link 906 may transmit processed measurements to external control 800 and controls to central processing unit 605 via a communication link 906. Communication link 906 may be executed wirelessly or through a direct electrical connection. Likewise, external control 800 may be connected to base 700 via communication link 910. As previously described, communication link 910 may transmit processed measurements to external control 800 and base commands to base processing unit 705 via a communication link 910. Communication link 910 may be executed wirelessly or through a direct electrical connection. Additionally, external control may generate base commands autonomously or manually and transmit via communication link 910 to base processing unit 705. Communication link 908 may transmit processed measurements from base unit 705 to central processing unit 605 and controls from central processing unit 605 to base processing unit 705. External power 902 may provide power supply 703 (e.g., referring to FIG. 7) via direct electrical connection. External Power 904 may be temporary or permanent depending on the implementation of power supply 703 and provided through direct electrical contact via base user interface 704 (e.g., referring to FIG. 7) or through inductive charging.

Figure 10:
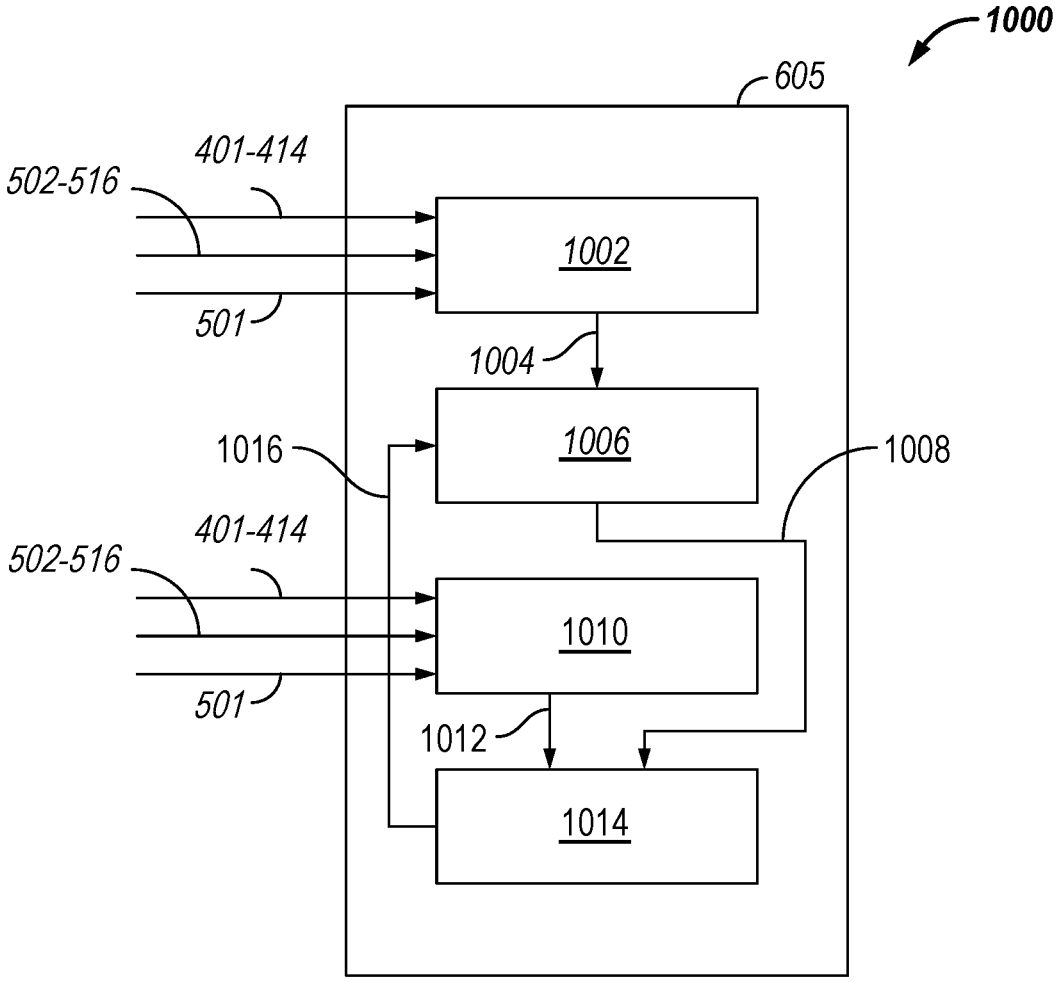
FIG. 10 illustrates an algorithm to update dummy parameters.

FIG. 10 illustrates algorithm 1000, as previously described algorithm 1000 may be comprised into central processing unit 605. Direct measurements at time Ti from FSRs within strike zones 401-413, accelerometers and gyroscopes within movement zones 502-516, and visual sensors 501 may be received in real time by block 1002. In block 1002 standard data processing techniques may be performed to process aforementioned measurements and produce user's performance 1004. User's performance 1004 may be received by training scheme 1006. Training scheme 1006 may compare user's performance 1004 to current dummy parameters while training dummy 100 is engaged and output updated dummy parameters 1008 to central processing unit 605 (not illustrated). Additionally, updated dummy parameters 1008 may be sent to block 1014. Direct measurements at time $T_{n+1}$ from FSRs within strike zones 401-413, accelerometers and gyroscopes within movement zones 502-516, and visual sensors 501 may be received in real time by block 1010. In block 1010 standard data processing techniques may be performed to process aforementioned measurements and produce a new user's performance 1012. New user's performance 1012 and updated dummy parameters 1008 may be compared at block 1014 to produce a feedback dummy parameter 1016. Feedback dummy parameters 1016 may alter current dummy parameters within training scheme 1006 prior to comparison of current dummy parameters with user's performance 1004. In certain examples, an alteration of current dummy parameters based off feedback dummy parameters 1016 and a comparison of user's performance 1004 to current dummy parameters are both performed. In other examples, only one or the other may be performed. In all examples, the updated product of dummy parameters within training scheme 1006 is output to central processing unit 605. Any number of iterations may be performed by training scheme 1006 and blocks 1010 and 1014 to update dummy parameters. All calculations may be performed in real time to provide consistent updated dummy parameters to central processing unit 605.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure comprises any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

What is claimed is:

1. A training dummy comprising:
- a head rotatably connected to a torso by a neck;
- a trunk rotatably connected to the torso;
- a pair of arms rotatably connected to the torso;
- a pair of legs rotatably connected to the trunk;
- a plurality of actuators configured to move the head, the torso, the trunk, the pair of arms, and the pair of legs at a plurality of articulation points;
- one or more force resistive sensors disposed in the head, the torso, the trunk, the pair of arms, or the pair of legs and configured to detect a physical force;
- one or more visual sensors on board the training dummy configured to observe surroundings of the training dummy;
- a central processing unit on board the training dummy communicatively connected to the plurality of actuators, the one or more force resistive sensors, and the one or more visual sensors and configured to control the plurality of actuators based at least on measurements of the one or more visual sensors and dummy parameters, wherein the dummy parameters comprise speed and/or power of the training dummy.

2. The training dummy of claim 1, further comprising one or more external controls configured to communicate with the central processing unit.

3. The training dummy of claim 2, wherein the one or more external controls are configured to update dummy parameters through the central processing unit.

4. The training dummy of claim 1, further comprising:
- a first shoulder attached laterally to the torso by a first shoulder joint;
- a second shoulder attached laterally to the torso by a second shoulder joint; and
- a first arm of the pair of arms attached to the first shoulder; and
- a second arm of the pair of arms attached to the second shoulder.

5. The training dummy of claim 4, the first arm and the second arm further comprise:
- a first bicep connected to the first arm;
- a second bicep connected to the second arm;
- a first forearm connected to the first bicep by a first elbow joint;
- a second forearm connected to the second bicep by a second elbow joint;
- a first hand connected to the first forearm by a first wrist joint; and
- a second hand connected to the second forearm by a second wrist joint.

6. The training dummy of claim 1, wherein the one or more actuators comprise a shoulder joint, elbow joint, a wrist joint, a hip joint, a knee joint, and an ankle joint.

7. The training dummy of claim 1, wherein the trunk comprises a pelvic base which the pair of legs attach to.

8. The training dummy of claim 1, wherein the central processing unit further comprises an algorithm, configured to update dummy parameters with measurements at different times.

9. The training dummy of claim 1, wherein the one or more actuators comprises servo motors, joint motors, linear actuators, rotary actuators, and combinations thereof.

10. The training dummy of claim 1 further comprising a plurality of LEDs disposed within a plurality of strike zones of the training dummy configured to provide a visual feedback to a user, wherein the plurality of LEDs emits a plurality of colors upon reaching a programmable threshold of a physical force applied to a strike zone of the plurality of strike zones detected by the one or more force sensors.

11. The training dummy of claim 1, further comprising:
- a battery management system on board the training dummy configured to provide power to the plurality of actuators; and
- one or more accelerometers and/or gyroscopes disposed within one or more movement zones of the training dummy;
- wherein the central processing unit on board the training dummy is further communicatively connected to the battery management system and the one or more accelerometers and/or gyroscopes through the one or more wired or wireless connections;
- wherein control of the plurality of actuators comprises autonomous commands generated in real time with the central processing unit on board the training dummy;
- wherein the control of the plurality of actuators is additionally based at least on:
  - a representation of the surroundings rendered from the measurements of the one or more visual sensors;
  - measurements of the one or more force resistive sensors,
  - spatial orientation of at least one component selected from the group consisting of:

the head, the trunk, the pair of arms, the pair of legs, and any combination thereof based at least on measurements of the one or more accelerometers and/or gyroscopes; and wherein the dummy parameters further comprise a preselected difficulty level or a fighting technique.

12. A training system comprising:

a moveable base; and a training dummy comprising:

a head rotatably connected to a torso by a neck;

a trunk rotatably connected to the torso;

a pair of arms rotatably connected to the torso;

a pair of legs rotatably connected to the trunk;

a plurality of actuators configured to move the head, the torso, the trunk, the pair of arms, and the pair of legs at a plurality of articulation points;

one or more force resistive sensors disposed in the head, the torso, the trunk, the pair of arms, or the pair of legs and configured to detect a physical force;

one or more visual sensors on board the training dummy configured to observe surroundings of the training dummy;

a battery management system on board the training dummy configured to provide power to the plurality of actuators;

a central processing unit on board the training dummy communicatively connected to the plurality of actuators and the battery management system and configured to control the plurality of actuators based at least on measurements of the one or more visual sensors and dummy parameters, wherein the dummy parameters comprise speed and/or power of the training dummy;

wherein the moveable base is communicatively coupled to the central processing unit, wherein the moveable base is configured to charge a battery on board the training dummy, and wherein the training dummy is configured to be mounted on the moveable base.

13. The training system of claim 12, further comprising an external control, wherein the external control is configured to communicate with the moveable base and the training dummy.

14. The training system of claim 13, wherein the external control comprises a user interface, wherein the user interface is configured to display one or more measurements from the training dummy.

15. The training system of claim 14, wherein the user interface is further configured to assess and customize one or more movements of the training dummy.

16. The training system of claim 12, wherein the moveable base is configured to support the training dummy during charging operations.

17. A method for training with a training system comprising:

providing a user interface for controlling operations of a training dummy, wherein the training dummy comprises:

a head rotatably connected to a torso by a neck;

a trunk rotatably connected to the torso;

a pair of legs rotatably connected to the trunk;

a plurality of actuators configured to move the head, the torso, the trunk, the pair of arms, and the pair of legs at a plurality of articulation points;

a plurality of force sensors disposed in the head, the torso, the trunk, the pair of arms, or the pair of legs and configured to detect a physical force;

one or more visual sensors on board the training dummy configured to observe surroundings of the training dummy;

a central processing unit on board the training dummy communicatively connected to the plurality of actuators, the one or more force resistive sensors, and the one or more visual sensors and configured to control the plurality of actuators based at least on measurements of the one or more visual sensors and dummy parameters, wherein the dummy parameters comprise speed and/or power of the training dummy;

measuring an applied physical force with the plurality of force sensors;

comparing the applied force to a programmable threshold to produce a user result; and displaying a feedback based in part on the user result.

18. The method of claim 17, further comprising commanding one or more movements of the training dummy at least based in part on the applied physical force.

19. The method of claim 18, wherein the commanding is programmed by the user.

20. The method of claim 17, wherein the feedback comprises a plurality of LEDs disposed within a plurality of strike zones of the training dummy, wherein the plurality of LEDs emit a plurality of colors upon reaching a programmable threshold of a physical force applied to the strike zone detected by the plurality of force sensors disposed within the training dummy.

* * * * *